US009975731B2

(12) United States Patent
Osmanbasic et al.

(10) Patent No.: US 9,975,731 B2
(45) Date of Patent: May 22, 2018

(54) ELEVATOR INSTALLATION WITH A SPEED LIMITER

(71) Applicant: Inventio AG, Hergiswil (CH)

(72) Inventors: Faruk Osmanbasic, Cham (CH); Daniel Meierhans, Lucerne (CH)

(73) Assignee: INVENTIO AG, Hergiswil (CH)

( * ) Notice: Subject to any disclaimer, the term of this patent is extended or adjusted under 35 U.S.C. 154(b) by 293 days.

(21) Appl. No.: 14/650,600

(22) PCT Filed: Dec. 6, 2013

(86) PCT No.: PCT/EP2013/075844
§ 371 (c)(1),
(2) Date: Jun. 9, 2015

(87) PCT Pub. No.: WO2014/090705
PCT Pub. Date: Jun. 19, 2014

(65) Prior Publication Data

US 2015/0329322 A1 Nov. 19, 2015

(30) Foreign Application Priority Data

Dec. 10, 2012 (EP) ..... 12196342

(51) Int. Cl.
*B66B 5/04* (2006.01)

(52) U.S. Cl.
CPC ..... *B66B 5/046* (2013.01)

(58) Field of Classification Search
CPC ..... B66B 5/046; B66B 5/044
See application file for complete search history.

(56) References Cited

U.S. PATENT DOCUMENTS

| | | | | |
|---|---|---|---|---|
| 5,565,660 | A | 10/1996 | Karner | |
| 5,630,483 | A | 5/1997 | Karner | |
| 2012/0061189 | A1* | 3/2012 | Imfeld | B66B 5/044 187/350 |

FOREIGN PATENT DOCUMENTS

| | | | | |
|---|---|---|---|---|
| CA | 2816359 | A1 * | 6/2012 | B66B 5/04 |
| CN | 201211987 | Y | 3/2009 | |
| CN | 102196986 | A | 9/2011 | |

(Continued)

OTHER PUBLICATIONS

English Machine Translation of DE 3504264.*

*Primary Examiner* — William E Dondero
*Assistant Examiner* — Diem M Tran
(74) *Attorney, Agent, or Firm* — William J. Clemens; Shumaker, Loop & Kendrick, LLP

(57) ABSTRACT

A speed limiter for an elevator installation includes a stand, a wheel rotatably mounted on the stand and a non-circularly extending guide surface rotatable with the wheel. A pendulum, which is pivotable relative to the stand, with a pendulum wheel bearing against the guide surface is provided. In addition, a restraining device is provided, which loads the pendulum wheel at least indirectly with a restraining force against the guide surface. A switching vane connected with the pendulum comes into engagement with a blocking dog, which dog is connected at least indirectly with the wheel, when the pendulum is pivoted out to a certain extent in which the pendulum wheel lifts off the guide surface. In addition, an actuating device that triggers the engagement between the switching vane and the blocking dog is provided.

15 Claims, 4 Drawing Sheets

(56) References Cited

FOREIGN PATENT DOCUMENTS

| | | | | | |
|---|---|---|---|---|---|
| CN | 102216189 | A | | 10/2011 | |
| CN | 102803115 | A | | 11/2012 | |
| DE | 3504264 | A1 | | 8/1985 | |
| DE | 3615270 | A1 | | 3/1987 | |
| GB | 2179795 | A | * | 3/1987 | ..... B66B 5/04 |
| WO | 9823526 | A1 | | 6/1998 | |
| WO | 0197238 | A1 | | 12/2001 | |
| WO | 2010139667 | A2 | | 12/2010 | |

* cited by examiner

ELEVATOR INSTALLATION WITH A SPEED LIMITER

FIELD

The invention relates to a speed limiter for an elevator installation, to an elevator installation with a speed limiter and to a method for limiting the speed of an elevator car of an elevator installation.

BACKGROUND

A speed limiter which monitors the travel speed of an elevator car is known from DE 36 15 270 A1. In operation, the speed limiter works as follows: An elevator car drives a cable pulley of the speed limiter in known manner by way of a wire cable, wherein a blocking ring and a cam wheel are integrated in the cable pulley. A pendulum roller follows a track of the cam wheel. A restraining spring is set so that the pendulum roller follows the cam of the cam wheel up to the elevator rated speed. The pendulum lever is set into pendulating motions with alternating direction by the cam via the pendulum roller. If the elevator speed exceeds a specific trigger value preset by the restraining spring then the pendulum roller lifts off the cam wheel. The moment of inertia of the pendulum lever is greater than the restraining moment of the restraining spring. The pendulum lug remains in the path of the blocking ring, which leads to blocking of the cable pulley. The force for engagement of the safety device is built up by the friction in a cable groove of the cable pulley.

The speed limiter known from DE 36 15 270 A1 has the disadvantage that checking of functional capability is complicated.

A device for limiting downward travel of an elevator is known from DE 35 04 264 A1. In that regard, it can be assumed that elevators are subject to inspection and regular checks which are usually carried out by a technical monitoring organization. In that case it is known to perform safety braking tests below a normal trigger speed. In principle, in the case of a safety brake test the blocking dog can be engaged by manual pressure at the location of the speed limiter. Since, however, moved parts are involved there is then a risk of injury. Moreover, an increased expenditure of time and disturbing contaminations arise. Through a safety brake, in which by pressing a button a rod is electromagnetically moved by way of remote triggering, the blocking dog can engage in the blocking wheel via a deflecting lever in the known speed limiter. It is possible through such an attachment unit, even in the case of an arrangement of the speed limiter with poor accessibility, to engage the cam of the pendulum in the intermediate space of the blocking wheel by remote triggering from desired vantage point and thus initiate the safety braking procedure for safety braking of the elevator.

A device for remote triggering of a speed limiter, by means of which the speed limiter can also be reset back into its operational setting, is known from U.S. Pat. No. 5,630,483. In that case, an actuating device is selectably activated in an actuation direction or actuated in a reset direction.

SUMMARY

An object of the invention is to provide a speed limiter for an elevator installation, an elevator installation with a speed limiter and a method for a speed limiter of an elevator car, which are designed to be an improvement or a simplification. In particular, it is an object of the invention to indicate a speed limiter for an elevator installation, an elevator installation with a speed limiter and a method for a speed limiter of an elevator installation in which, particularly in the case of a function test, a simple remotely activated resetting is made possible, which makes direct presence of an operative, particularly a test engineer, at the speed limiter superfluous.

According to a proposed solution the speed limiter comprises a stand and a wheel rotatably mounted on the stand. The wheel is preferably connected with an elevator car by means of a trigger cable. The rotational speed of the wheel thus follows the travel speed of the elevator car. A mass body is moved in correspondence with a speed curve of the wheel and on reaching a predetermined rotational speed of the wheel the mass body pivots out. The wheel of the speed limiter is preferably braked or blocked, or an auxiliary brake is actuated, by this outward pivotation. The trigger cable is thereby braked, in which case, for example, a safety brake of the elevator car can be actuated.

Through the outward pivotation of the mass body a switching vane is in addition pivoted from a neutral pivot setting to a switching position. This is preferably reinforced by the fact that the mass body through its outward pivotation comes into engagement with the wheel, whereby the rotating wheel pivots the switching vane. The switching vane can, through the pivotation, actuate a switch which then in turn, for example, interrupts a safety circuit of the elevator and stops the elevator. In addition, the speed limiter comprises an actuating device to actuate the speed limiter. The actuating device is preferably actuable from a distance, for example by means of an electrical signal. For the purpose of actuation, the actuating device can pivot out the mass body together with the switching vane and can accordingly, for example, bring it into engagement with the moved wheel. Thus in addition the switching vane is pivoted and the switch actuated. According to the solution the actuating device in that case is designed so that in the event of fresh actuation or in the event of repetition of the actuation the mass body is again pivoted out together with the switching vane and in that case resets the switching vane to the neutral pivot setting when the wheel is stationary. This is achieved by the fact that that an actuating force of the actuating device is so selected that it does not prevent pivotation of the switching vane, for example through the effect of engagement with the wheel. The actuating device on actuation can thus initially actuate the mass body and thereby trigger the switch and brake a trigger cable if present. In the case of a further, later actuation of the actuating device this urges the switching vane back into its neutral pivot setting, since at this point in time the wheel of the speed limiter is stationary.

An actuation direction of the actuating device is in that regard identical for all actuations. In the case of initial actuation or pivotation of the mass body the switching vane is thus moved by the engagement with the rotating wheel. Since, in the case of later resetting of the speed limiter, with corresponding movement of the actuating device in the same actuation direction the wheel is stationary, thus exerts no force on the switching vane, the switching vane can be reset into its neutral pivot setting by this same form of actuation.

Since at this later point in time the elevator installation is in the rest state—because it was stopped by the switch or by a safety brake if present—the mass body is usually reset back into its original setting and accordingly no longer pivoted out. Thus, with a single actuating device the speed limiter and the fundamental mechanical parts of the speed limiter can be reset again by remote actuation.

It is advantageous, in particular, that merely one and the same signal can be used for the remote triggering and for subsequent resetting. Incorrect actions are thereby prevented. The mode of triggering or resetting is resolved from the operational state of the elevator installation. When the elevator car or the speed limiter is moved the speed limiter is actuated and when the limiter is stationary the switching vane is reset.

Advantageously, an actuating device of that kind is used with a so-called pendulum limiter. A speed limiter of that kind further includes a non-circularly extending guide surface which is rotatable with the wheel. The mass body is in that case a pendulum, which is pivotable with respect to the stand, with a pendulum wheel bearing against the guide surface. A restraining device, for example a spring, draws the pendulum wheel or the pendulum against the guide surface. The switching vane is connected with the pendulum. With increasing rotational speed of the wheel the pendulum or the pendulum roller is no longer capable of following the guide surface and it lifts off the guide surface. In the event of a predetermined outward pivotal movement of the pendulum, in which the pendulum wheel lifts off the guide surface, the pendulum or a lug of the pendulum comes into engagement with a blocking dog of the wheel. In that case, the switching vane is pivoted by the action of the blocking dog out of the neutral pivot setting into the switching position and the switch is thereby actuated. The preferably remotely actuable actuating device is so constructed that when required it lifts the pivotable pendulum off the guide surface and can bring the pendulum together with the switching vane into engagement with the blocking dog. In addition, in that case the actuating device urges the switching vane by a predetermined force back into the neutral pivot setting. This force is so predetermined that it additionally enables pivotation of the switching vane when this comes into engagement with the blocking dog. A simple possibility is thus given of actuating a conventional, inexpensive pendulum limiter from a distance and also resetting it again.

It is advantageous if the switching vane is pivotable about a fulcrum between the switching vane and the pendulum and if the actuating device in at least one engagement setting of the switching vane in which the switching vane is in engagement with the blocking dog so acts at least indirectly on the switching vane that the switching vane is pivotable back about the fulcrum into a neutral pivot setting after the engagement between the switching vane and the blocking dog has been cancelled. In that case the actuating device can be remotely controllable. Consequently, for example, actuation by the actuating device from outside a lift an elevator shaft can be triggered in order to reset the switching vane into the neutral pivot setting.

The switch which is actuated by the pivoting switching vane is preferably a so-called detenting switch. A detenting switch maintains a switched setting until it is reset again by external action. The detenting switch is preferably similarly resettable from a distance. This can be, for example, a detenting switch with electromagnetic resetting, in which, for example, in the case of actuation a magnet retaining force has to be overcome and which can be reset again by means of an electromagnetic coil, even from a distance. Multiple switching of the switch is thus prevented, which can happen, for example, due to dynamic rebounding of the pendulum when actuated.

It is also advantageous if an actuating element is provided and if the actuating device acts by way of the actuating element on at least one abutment element of the switching vane for resetting the switching vane into the neutral pivot setting. In that regard it is additionally of advantage if the abutment element of the switching vane is designed as a lug. For example, the switching vane can be made from sheet metal, in which case the lug is formed by bending over a part of the sheet metal. A robust and inexpensive production of the switching vane is thereby possible.

Moreover, it is advantageous if an abutment element is provided at the fulcrum between the pendulum and the switching vane and if the actuation device in the case of a function test so actuates the switching vane from a neutral pivot setting, in which the pendulum wheel of the pendulum bears against the guide surface, via the actuating element and the abutment element of the switching vane, which is provided at the fulcrum, that through an at least substantially translational movement of the switching vane the switching vane comes into engagement with the blocking dog when the wheel is rotating. The function test can thus be performed at the same time by the same actuating device. In that regard, the wheel is set into rotation via the trigger cable by a suitable movement of the elevator car in the elevator shaft. The switching vane or the mass body is then adjusted by way of the actuating device so that the switching vane comes into engagement with one of the blocking dogs of the rotating wheel. Blocking of the wheel thereupon occurs and a trigger force can be transmitted by way of the friction of the trigger cable in a groove of the wheel. This trigger force can be transmitted directly or indirectly to the safety brake. In particular, a trigger linkage of the safety brake can be moved so that the safety brake of the elevator car is engaged. This can take place, in particular, during descent of the elevator car. Subsequently, resetting of the switching vane into the neutral pivot setting can be achieved again by repeated triggering of the actuating device. A preset function test can thus be performed without direct intervention in the speed limiter.

It is also advantageous if the blocking dog and the switching vane are so designed that the switching vane is pivoted about the fulcrum between the switching vane and the pendulum when the switching vane comes into engagement with the blocking dog when the wheel is rotating. This mechanism can also be realized for both directions of rotation of the wheel. In that regard it is advantageous if the blocking dog and the switching vane are so designed that the switching vane is pivoted in a first pivot direction about the fulcrum between the switching vane and the pendulum when the switching vane comes into engagement with a blocking dog when the wheel is rotating in a first direction of rotation and is pivoted in a second pivot direction opposite to the first direction about the fulcrum between the switching vane and the pendulum when the switching vane comes into engagement with a blocking dog when the wheel is rotating in a second direction opposite to the first direction, and if in the case of pivotation of the switching vane in the first pivot direction a first abutment element of the switching vane is pivoted closer to the actuating element than the abutment element at the fulcrum, as well as if the case of pivotation of the switching vane in the second direction a second abutment of the switching vane is pivoted closer to the actuating element than the abutment element at the fulcrum. The actuating element is adjusted when subsequent triggering of the actuating device takes place. In that case, the actuating element co-operates with the abutment element, which is arranged closer to the actuating element than the abutment element at the fulcrum. Through corresponding loading of the switching vane, a pivotation which is directly opposite to the preceding pivotation takes place. The switching vane is thereby pivoted back into the neutral setting in which the engagement between the switching vane and the blocking dog is cancelled.

It is advantageous if the switching vane has a dovetail-shaped engagement section by which the switching vane comes into engagement with the blocking dog and if the blocking dog has a profile matched to the dovetail-shaped engagement section. For the function test, the dovetail-shaped engagement section of the switching vane, when the actuating device is triggered by way of the actuating element, is displaced into the cam ring of the rotating wheel so that the dovetail-shaped engagement section comes into engagement with one of the blocking dogs. As a result, blocking of the wheel occurs and thus gives rise to the desired friction force which acts on the trigger cable guided in the groove of the wheel. Accordingly, triggering of the safety brake takes place in operation when the pendulum wheel of the pendulum lifts off of the guide surface and thus the dovetail-shaped engagement section comes into engagement with a blocking dog.

It is also advantageous if the actuating device loads the actuating element by a limited, predetermined actuation force. For example, the predetermined actuation force can be exerted by the magnet force of a stroke magnet of the actuating device. The actuation force is in that case limited so that pivotation of the switching vane is made possible when the switching vane comes into engagement with the blocking dog. Mutual impairment of the actuating device and the mode of operation of the blocking wheel is thereby prevented.

DESCRIPTION OF THE DRAWINGS

Preferred embodiments of the invention are explained in more detail in the following description on the basis of the accompanying drawings, in which corresponding elements are provided with corresponding reference numerals and in which.

DETAILED DESCRIPTION

Figure 1:
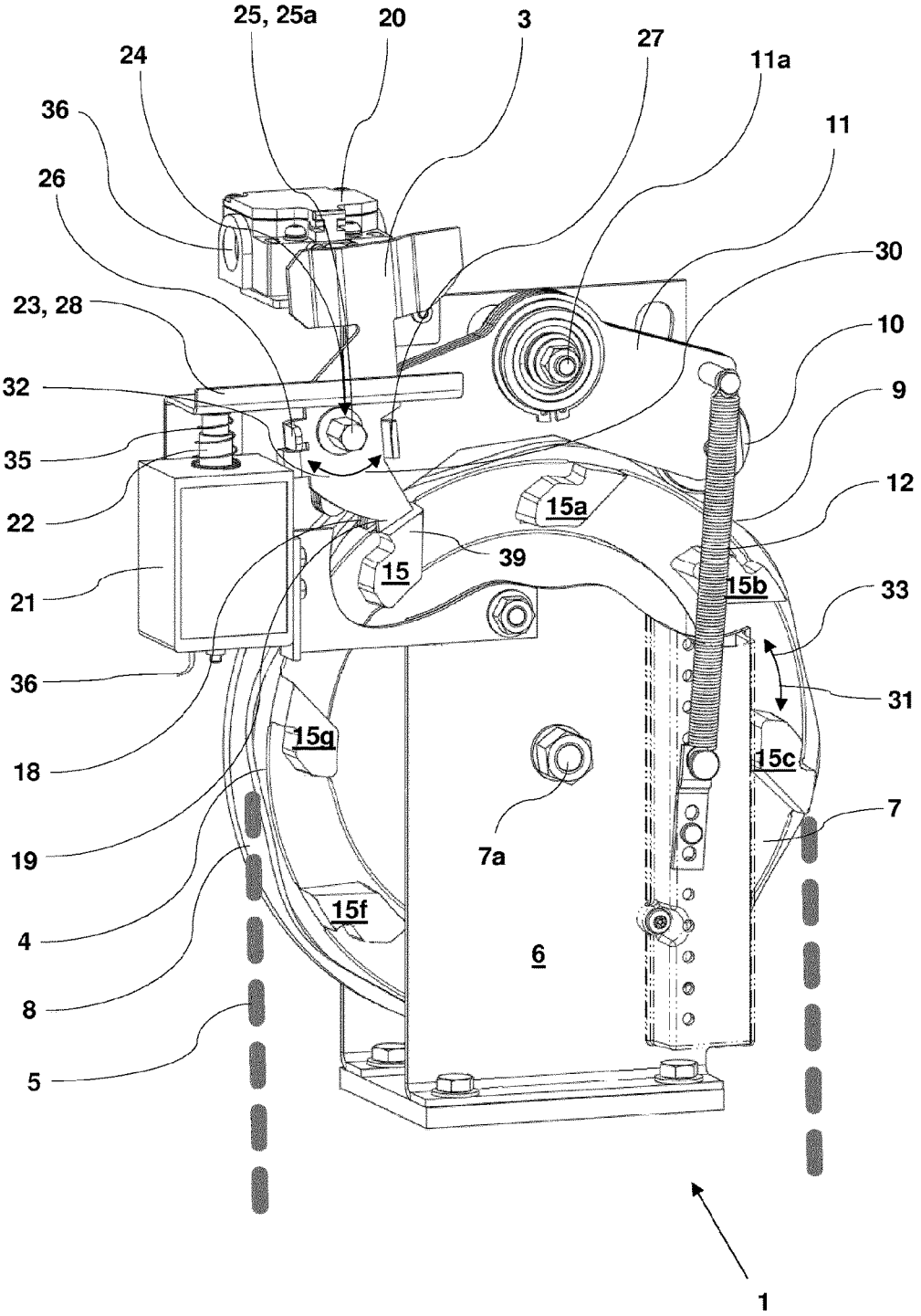
FIG. 1 shows a speed limiter of an elevator installation in correspondence with an embodiment of the invention in a schematic perspective illustration, wherein a switching vane is disposed outside a cam ring.
Figure 4:
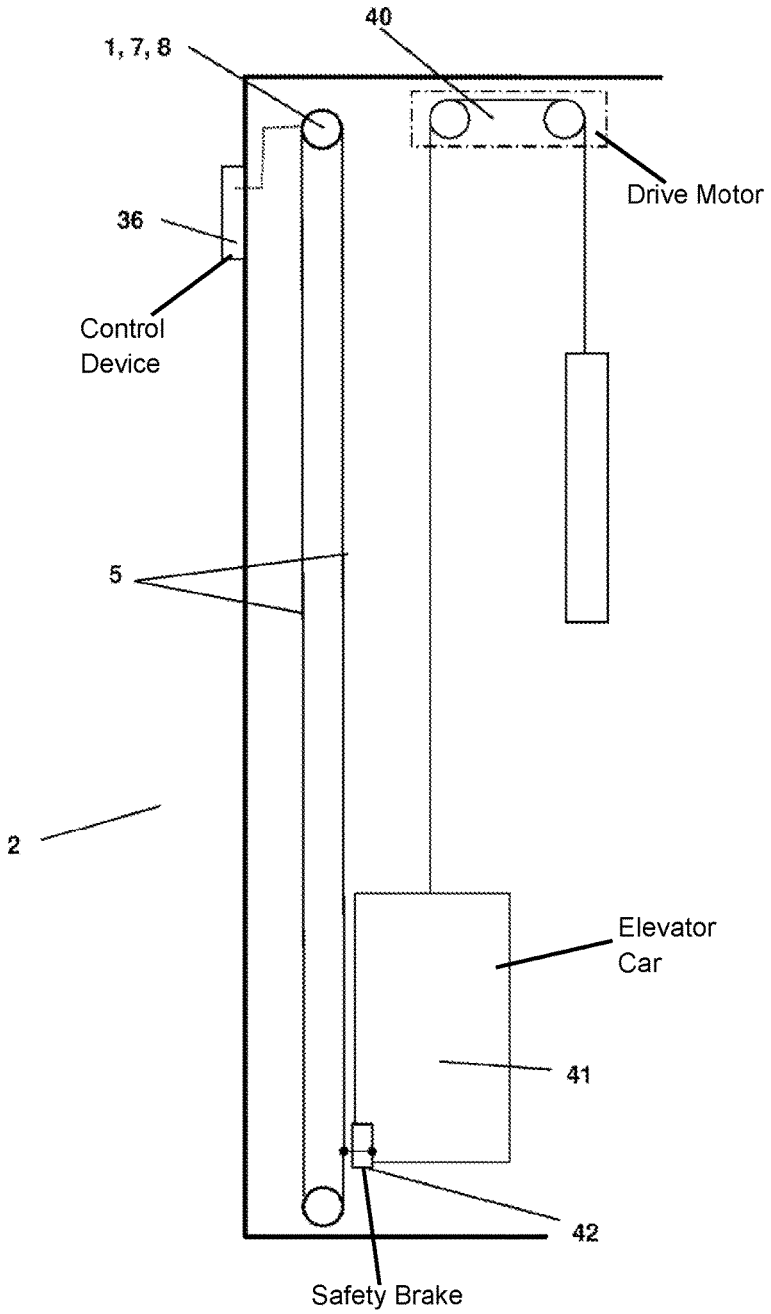
FIG. 4 shows an elevator installation with an installed speed limiter.

FIG. 1 shows a speed limiter 1 for an elevator installation 2 in correspondence with an embodiment of the invention in a schematic, perspective illustration. In that case, illustrated in FIG. 1 is a setting in which a switching vane 3 is disposed in a neutral pivot setting and, in addition, outside a cam ring 4. The elevator installation 2 additionally comprises a trigger cable 5 as well as an elevator car 41, which is illustrated in FIG. 4 and which is movable in an elevator shaft.

The exemplifying speed limiter 1 monitors the speed of the elevator car 41 by way of a pendulum principle. The speed limiter comprises a stand 6 and a wheel 7 mounted on the stand 6 to be rotatable about a bearing point 7*a*. A groove 8, in which the trigger cable 5 is guided, is formed at the wheel 7. In addition, the wheel 7 has a non-circularly extending guide surface 9. The guide surface 9 can in that case describe a wave-shaped movement in radial direction, during rotation of the wheel 7, at a circumferential point selected to be fixed with respect to the stand 6. A pendulum wheel 10 of a pendulum 11 runs on the guide surface 9 and executes the conjunctive movement caused by the guide surface 9. For that purpose the pendulum 11 is mounted in the stand 6 by means of a bearing 11*a*. However, from a certain rotational speed the pendulum wheel 10 lifts off the guide surface 9, whereby the speed limitation is effective.

On rotation of the wheel 7 the pendulum 11 thus follows the guide surface 9 when the rotational speed remains below a predetermined value. In that regard, the pendulum 11 together with the pendulum wheel 10 is loaded towards the guide surface 9 by a restraining force of a restraining device 12. In this embodiment the restraining device 12 is formed by a spring 12. When the rotational speed exceeds the value settable by a bias of the spring 12 then the pendulum 11 together with the pendulum wheel 10 lifts off, whereby the switching vane 3 connected with the pendulum 11 is actuated. The spring can, for example, be individually biased by means of a series of holes provided in the stand 6. For better protection, the spring is covered in operation by a protective cap.

The functioning of the speed limiter 1 is further described in the following also with reference to FIG. 2. The stand 6 is illustrated in FIGS. 1 and 2 partly cut away so as to be able to better explain the functioning.

Figure 2:
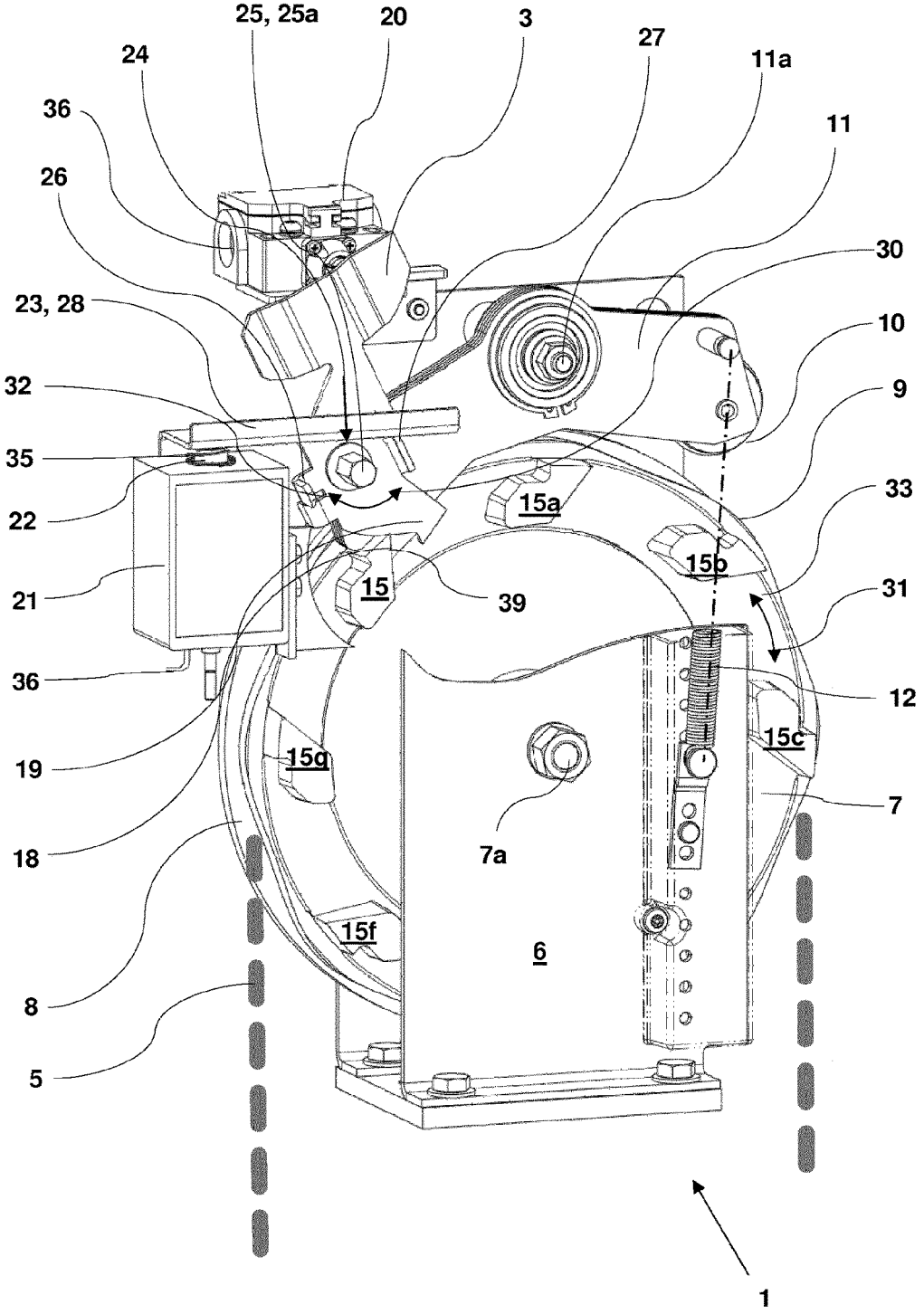
FIG. 2 shows the speed limiter illustrated in FIG. 1, wherein the switching vane is disposed in engagement with a blocking dog.

FIG. 2 shows the speed limiter 1 illustrated in FIG. 1, wherein the switching vane 3 is disposed in engagement with a blocking dog 15 of the cam ring 4. The cam ring 4 has the blocking dog 15 and further blocking dogs 15*a* to 15*g* (partly not visible). As long as the pendulum wheel 10 rolls along the guide surface 9, a dovetail-shaped engagement section 19 of the switching vane 3 as well as a pendulum lug 18 repeatedly re-enter between the blocking dogs 15 to 15*g* of the cam ring 4. However, the engagement section 19 as well as the pendulum lug 18 are then always disposed above these blocking dogs 15 to 15*g*, as is illustrated in FIG. 1, as a consequence of the guide surface 9 extending in wave shape in the region of the individual blocking dogs 15 to 15*g*. Only if the pendulum 11 together with its pendulum wheel 10 lifts off the guide surface 9 do the engagement section 19 of the switching vane 3 and the pendulum lug 18 collide with one of the blocking dogs 15 to 15*g* of the cam ring 4. The engagement section 19 of the switching vane 3, which is upstream of a profile of the pendulum lug 18, thereby comes into engagement with, for example, the blocking dog 15 as illustrated in FIG. 2.

In that event, the switching vane 3 can actuate a switch 20. The switch 20 can be, for example, part of a safety circuit of the elevator installation 2. Through actuation of the switch 20 the safety circuit can then be interrupted so that, inter alia, a motor of a drive motor unit 40 (see FIG. 4) can be switched off.

If the pendulum lug 18 collides with the blocking dog 15 and then is in engagement with the blocking dog 15, the wheel 7 is blocked. The trigger cable 5, which runs in the groove 8 of the wheel 7, is thereby braked and transmits a trigger force to a trigger linkage of a safety brake 42 or the like. Through further movement of the elevator car 41 in the elevator shaft, particularly lowering of the elevator car 41, the trigger linkage is moved so that the safety brake 42 of the elevator is engaged. The elevator car 41 is thereby braked and stopped.

When placing the elevator installation 2 in operation or in the context of regular inspection it has to be evidenced that the trigger force transmitted by the speed limiter 1 via the trigger cable 5 is sufficient to trigger the safety brake 42. For that purpose, for example, the speed limiter 1 can be remotely triggered at a specific nominal or test speed. This takes place by way of an actuating device 21 which can be remotely triggered and which can comprise an electric stroke magnet 21. Whilst the elevator car travels at the test or nominal speed the stroke magnet 21 by way of an actuating pin 22 draws an actuating element 23 downwardly in an actuation direction 24. An abutment element 25*a* is provided at a fulcrum 25 between the pendulum 11 and the switching vane 3. The actuating element 23 adjusted in the actuation direction 24 hits against the abutment element 25*a* and entrains this in the actuation direction 24. The switching vane 3 is thus entrained in the actuation direction 24 so that, starting from the setting illustrated in FIG. 1, the engagement section 19 comes into engagement with the blocking dog 15 and the wheel 7 of the speed limiter 1 is blocked. In that case, the switching vane rotatable about the fulcrum 25 at the abutment element 25*a* additionally actuates the switch 20. The thus-achieved setting is illustrated in FIG. 2.

In order to reset the speed limiter 1 again initially the elevator car is lifted so as to relieve the trigger cable 5 of load. The switch 20 can be reset electrically. A suitable stroke magnet, for example, can serve for resetting the switch 20 or use can be made of a proprietary remotely resettable switch. In that case, remotely actuated resetting of the switch 20 is also possible. The switch 20 can also be manually reset by hand.

The switching vane 3 can, in advantageous manner, be automatically reset. In this embodiment this is possible by a further triggering of the actuating device 21. Thus, on the one hand user friendliness can be improved, since, so to speak, both the switching vane 3 and—possibly with a delay in time—the switch 20 can be reset by pushing a button. Moreover, safety in operation can thereby be improved. In particular, convenient and safe resetting from a distance can be effected even in cases in which the speed limiter 1 is, for example, accommodated in the shaft head of an elevator shaft and thus directly reachable only from the roof of the elevator car.

In this embodiment, the actuating device 21 serves not only for triggering blocking of the speed limiter 1 in a test run, but also for resetting the switching vane 3 and thus the speed limiter 1. The two functions of an actuating device 21 can thereby be guaranteed. On the one hand this simplifies activation and on the other hand the construction of the speed limiter 1 is simplified. In addition, the need for space is also reduced.

The switching vane 3 comprises abutment elements 26, 27, which are formed as lugs 26, 27. In that case, the lugs 26, 27 are formed as bent-over sections of the switching vane 3. The abutment element 25*a* at the fulcrum 25 lies at least approximately between the lugs 26 and 27.

The actuating element 23 has a strip-shaped arm 28 and a guide part. The actuating element 23 at the actuating device 21 is guided in an opposite to the actuation direction 24 by the guide part. Depending on the respective pivot setting of the switching vane 3 the actuating element 23 can act on at least one of the abutment elements 25*a*, 26, 27 by way of the strip-shaped arm 28.

Starting from the neutral start setting illustrated in FIG. 1 the strip-shaped arm 28 acts, in the case of an actuation in the actuation direction 24, on the abutment element 25*a* so that the switching vane 3 is displaced at least substantially translationally in the actuation direction 24. When the wheel 7 is rotating the engagement section 19 thereby enters the cam ring 4 and thus comes into engagement with the blocking dog 15 or another blocking dog 15*a* to 15*g* of the cam ring 4.

If, thereagainst, the starting point is the setting illustrated in FIG. 2 in which the switching vane 3 is disposed in engagement with the blocking dog 15 and at the same time the trigger cable 5 is relieved of load, then in the case of actuation of the strip-shaped arm 28 of the actuating element 23 in the actuation direction 24 the strip-shaped arm 28 initially co-operates with the lug 27, because the lug 27 is in that case pivoted in a first pivot direction 30 about the fulcrum 25 of the abutment element 25*a* between the switching vane 3 and the pendulum 11 so that the lug 27 is arranged closer to the strip-shaped arm 28 than the abutment element 25*a*. The pivotation of the switching vane 3 in that regard takes place due to the fact that the wheel 7 is initially rotated in a first rotational direction 31 until the switching vane 3 comes into engagement with the blocking dog 15. The resulting collision causes pivotation of the switching vane 3 in the first pivot direction 30 about the fulcrum 25 of the abutment element 25*a*.

The abutting, which is triggered by the actuating element 21, of the strip-shaped arm 28 against the lug 27 now causes reverse pivotation of the switching vane 3 in a second pivot direction 32 about the fulcrum 25 of the abutment element 25*a*, which is directed oppositely to the first pivot direction 30. The switching vane 3 thereby transfers to a neutral pivot setting in which engagement between the switching vane 3 and the blocking dog 15 is cancelled. Due to the restraining force of the spring 12, in that case the switching vane 3 is displaced by way of the pendulum 11 against the actuation direction 24. The switching vane 3 is then again disposed in a setting as illustrated in FIG. 1. The actuating device 21 is thus actuated for triggering and resetting the speed limiter 1 or the switching vane 3 in the same or like actuation direction 24. The actuation direction 24 thus remains identical. In the case of actuation for resetting the speed limiter 1, the same actuation as for triggering the speed limiter 1 is therefore used repeatedly.

Figure 3:
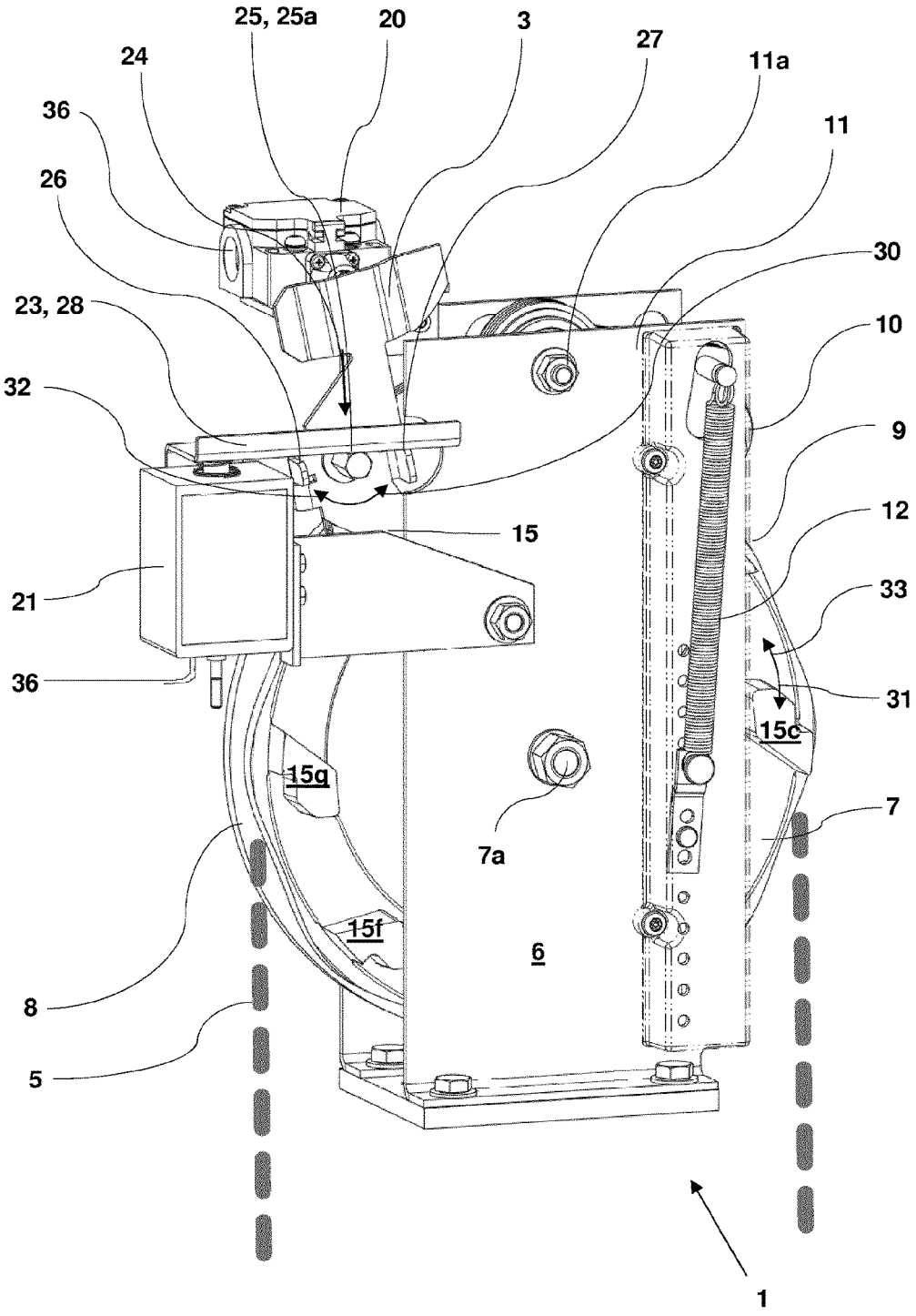
FIG. 3 shows the speed limiter illustrated in FIG. 1, wherein cancellation of the engagement between the switching vane and the blocking dog is illustrated.

FIG. 3 shows the speed limiter 1 illustrated in FIG. 1, wherein cancellation of the engagement between the switching vane 3 and the blocking dog 15 is illustrated. In that case the situation is illustrated in which the strip-shaped arm 28 of the actuating element 23 is adjusted by the actuating device 21 in the direction 24. Pivotation of the switching vane 3 in the second pivot direction 32 is then achieved by the action of the arm 28 on the lug 27, as explained in the foregoing.

In corresponding manner, the wheel 7 can obviously initially also rotate in a second direction 33 of rotation. If the dovetail-shaped engagement section 19 of the switching vane 3 now comes into engagement with the blocking dog 15 then the switching vane is pivoted about the fulcrum 25 of the abutment element 25*a* in the second pivot direction 32. Resetting can then similarly take place by triggering the actuating device 21. However, the strip-shaped arm 28 then co-operates with the lug 26 to pivot the switching vane 3 back in the first pivot direction 30 about the fulcrum 25 of the abutment element 25 into the neutral pivot setting in which the engagement between the switching vane 3 and the blocking dog 15 is cancelled.

Resetting of the switching vane 3 can thus be realized by way of the two abutment elements 26, 27, which serve for the resetting. In the case of activation of the speed limiter 1 the switching vane 3 with the two abutment elements 26, 27 rotates or pivots relative to the pendulum 11. Depending on the direction of activation of the speed limiter 1, which depends on whether the elevator car travels or upwardly, the switching vane 3 is also pivoted in the first pivot direction 30 or the second pivot direction 32. In that case, a respective one of the abutment elements 26 and 27 takes up a closer position to the strip-shaped arm 28 than the abutment element 25*a* at the fulcrum. On repeated actuation of the actuating device 21 the switching vane 3 is rotated back into the initial setting, thus the neutral pivot setting, by way of the action on the abutment element 26, 27 lying closer to the strip-shaped arm 28.

In addition, the switching vane 3 is designed so that the switch 20 is always actuated when the switching vane 3 is not in the neutral pivot setting. The switch 20 is thus always actuated when the switching vane 3 is pivoted in the first pivot direction 30 or the second pivot direction 32. The switch 20 can, in one possible variant of embodiment in that regard be executed as a button 20 and can independently return to its closed position when the switching vane 3 returns to the neutral pivot setting.

If the actuating device 21 comprises a stroke magnet then the setting illustrated in FIG. 1 corresponds with the stroke magnet not conducting current, whereas the setting illustrated in FIG. 3 corresponds with the stroke magnet conducting current.

The actuating force of the actuating device 21 is limited in suitable manner. In that case, consideration is given to the fact that for triggering the speed limiter 1 the strip-shaped arm 28 initially acts on the abutment element 25*a* in the actuation direction 24 and shortly thereafter, due to the rotating wheel 7 and the hitting against the blocking dog 15 which takes place, the respective lug 26, 27 going upwardly opposite to the actuation direction 24 can knock the strip-shaped arm 28 away from the abutment element 25*a*, as illustrated in FIG. 2. The actuating force of the actuating device 21 is therefore limited so that pivotation of the switching vane 3 is made possible when the switching vane 3 comes into engagement with the blocking dog 15. Damage of the actuating device 21 is thereby also prevented. In addition, a spring element 35 is provided, which loads the actuating element 23 against the actuating force of the actuating device 21. Permanent contact of the strip-shaped arm 28 with at least one of the abutment elements 25*a*, 26, 27 is thereby avoided, as is also shown in FIGS. 1 and 2.

Triggering of the actuating device 21 can take place by way of a separate control device 36. The separate control device 36 is connected in suitable manner with the actuating device 21. The control device 36 can, for remote activation of the actuating device 21, also be arranged at a distance from the speed limiter 1. In particular, the control device 36 can be arranged outside an elevator shaft. The control device 36 can in that case also be integrated in an elevator control. Moreover, an additional connection of the control device 36 with the switch 20 can be saved if the switch 20 is executed as a button. In a modified embodiment the control device 36 can, however, also be connected with the switch 20 so as to allow, for example, only specific resetting of the switch 20.

In addition, the blocking dogs 15 to 15*g* and the dovetail-shaped engagement section 19 of the switching vane 3 respectively have mutually matched profiles. For example, two sides of a profile 39 of the blocking dog 15 are matched to the dovetail-shaped engagement section 19 of the switching vane 3 and obviously also of the pendulum lug 18.

Thus, in a method for the speed limiter 1 of the elevator car of the elevator installation 2 the pendulum wheel 10 of the pendulum 11, which bears against the non-circularly extending guide surface 9 of the wheel 7, can be loaded by a restraining force towards the guide surface, wherein the switching vane 3 connected with the pendulum 11—at a specific pivoting-out movement of the pendulum 11 in which the pendulum wheel 10 lifts off the guide surface 9—comes into engagement with a blocking dog 15 connected with the wheel 7 and wherein through the actuation of the switching vane 3 by means of the actuating device 11 the switching vane 3 is reset into its neutral switching setting.

A regular check of the functional capability of the speed limiter 1 can thus take place in improved manner. Cases in which, for example, the trigger cable 5 is contaminated or excessively greased, so that a correct mode of functioning is no longer guaranteed, can thus be recognized. Risk of injury for the operative, particularly a test engineer, is in this regard largely excluded, since remote actuation for triggering and resetting the speed limiter 1 is made possible, which takes place, so to speak, by pressing a button from a remotely arranged control device 36.

The invention is not restricted to the described embodiments. Thus, the device can, for example, also be adapted to a speed limiter with mass bodies in the form of centrifugal weights instead of the described pendulum.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A speed limiter for an elevator installation comprising:

a stand;

a wheel rotatably mounted on the stand and driven in rotation by movement of an associated elevator car;

a mass body pivotally mounted on the stand in contact with the wheel, the mass body being pivoted out from the wheel when a predetermined rotational speed of the wheel is reached;

a switching vane pivotally mounted on the mass body, the switching vane being pivoted from a neutral pivot setting to a switching position by the pivoting of the mass body when the predetermined rotational speed of the wheel is reached;

a switch actuated by pivotation of the switching vane to the switching position; and an actuating device for pivoting the mass body and the switching vane, wherein the actuating device moves the switching vane into the neutral pivot setting from the switching position with a predetermined force so that pivotation of the switching vane occurs when the mass body is pivoted out, wherein the actuating device is actuatable to pivot out the mass body together with pivoting the switching vane to the switching position against the predetermined force when the wheel is rotating at less than the predetermined rotational speed, and wherein the actuating device upon a further actuation when the mass body is pivoted out moves the switching vane switching vane back into the neutral pivot setting when the wheel is stationary.

2. The speed limiter according to claim 1 including a non-circularly extending guide surface that is rotatable with the wheel, and wherein the mass body is a pendulum with a pendulum wheel bearing against the guide surface and a restraining device, which restraining device loads the pendulum wheel at least indirectly with a restraining force towards the guide surface, wherein the switching vane is connected with the pendulum and, when a predetermined pivoting-out movement of the pendulum occurs in which the pendulum wheel lifts off the guide surface, comes into an engagement with a blocking dog, which blocking dog is connected at least indirectly with the wheel, wherein the switching vane is pivoted from the neutral pivot setting to the switching position by the action of the blocking dog and thereby actuates the switch, wherein the actuating device lifts the pendulum wheel off the guide surface and brings the pendulum together with the switching vane into engagement with the blocking dog, and moves the switching vane into the neutral pivot setting, wherein the actuating device when actuated urges the switching vane into the neutral pivot setting so that pivotation of the switching vane is possible when the switching vane comes into engagement with the blocking dog.

3. The speed limiter according to claim 2 wherein the switching vane is pivotable about a fulcrum between the switching vane and the pendulum and the actuating device in at least one engagement setting of the switching vane in which the switching vane is in engagement with the blocking dog acts on the switching vane at least indirectly to pivot the switching vane about the fulcrum back into the neutral pivot setting.

4. The speed limiter according to claim 3 wherein the actuating device can draw an actuating element in an actuation direction by way of an actuating pin, an abutment element is provided at the fulcrum between the pendulum and the switching vane, and wherein the actuating device performs a function test by actuating the switching vane, by the actuating element and the abutment element, from the neutral pivot setting in which the pendulum wheel of the pendulum bears against the guide surface, through an at least substantially translational movement of the actuating element wherein the switching vane and the pendulum come into engagement with the blocking dog when the wheel is rotating.

5. The speed limiter according to claim 4 including a spring element for loading the actuating element against the actuating force.

6. The speed limiter according to claim 4 wherein the blocking dog and the switching vane are positioned so that the switching vane is pivoted about the fulcrum when the switching vane comes into engagement with the blocking dog when the wheel is rotating.

7. The speed limiter according to claim 6 wherein the blocking dog and the switching vane are positioned so that the switching vane is pivoted in a first pivot direction about the fulcrum when the switching vane comes into engagement with the blocking dog when the wheel is rotating in a first direction of rotation and is pivoted in a second pivot direction, opposite to the first pivot direction, about the fulcrum when the switching vane comes into engagement with the blocking dog when the wheel is rotating in a second direction of rotation opposite to the first direction of rotation, wherein when the switching vane is pivoted in the first pivot direction a first abutment element of the switching vane is pivoted closer to the actuating element than the abutment element at the fulcrum and when the switching vane is pivoted in the second pivot direction a second abutment element of the switching vane is pivoted closer to the actuating element than the abutment element at the fulcrum.

8. The speed limiter according to claim 2 wherein the switching vane has a dovetail-shaped engagement section by which the switching vane comes into engagement with the blocking dog and the blocking dog has a profile matched to the dovetail-shaped engagement section.

9. The speed limiter according to claim 1 including an actuating element and wherein the actuating device when actuated acts by the actuating element on at least one abutment element of the switching vane for resetting of the switching vane into the neutral pivot setting, wherein the actuating device acts by an actuating force on the actuating element wherein the actuating force determines the predetermined force by which the actuating device acts on the switching vane.

10. The speed limiter according to claim 1 wherein the switching vane when pivoted from the neutral pivot setting to the switching position actuates the switch, wherein the switch is a detenting switch that can be reset by remote activation.

11. The speed limiter according to claim 1 wherein the actuating device includes a stroke magnet generating an actuating force.

12. The speed limiter according to claim 1 wherein the actuating device is connected with a separate control device for remote activation of the actuating device.

13. An elevator with a speed limiter according to claim 1 including a trigger cable guided by a groove of the wheel and wherein the trigger cable is connected at least indirectly with a safety brake arranged at the elevator car.

14. A method of remote triggering and remote resetting of a speed limiter of an elevator car of an elevator installation, the method comprising the steps of:

actuating an actuating device to pivot out a mass body to bring the mass body into engagement with a wheel being driven in rotation by movement of the elevator car;

pivoting a switching vane from a neutral pivot setting to a switching position by the pivoting out of the mass body and the rotating wheel;

actuating a switch with the switching vane in the switching position, wherein the actuating device when actuated acts by a predetermined force on the switching vane to move the switching vane back into the neutral pivot setting, wherein the predetermined force is selected so that pivotation of the switching vane occurs when the mass body is pivoted out and engages with the rotating wheel, and wherein when the actuating device is actuated again the actuating device pivots out the mass body again and the switching vane is moved back into the neutral pivot setting when the wheel is at a standstill wherein the actuating device is actuated in a same actuation direction for pivoting out the mass body and for resetting the switching vane to the neutral pivot setting.

15. The method according to claim 14 wherein the switch is reset by an individual remote activation.

* * * * *